US005456543A

United States Patent [19]

Witte et al.

[11] Patent Number: 5,456,543

[45] Date of Patent: Oct. 10, 1995

[54] PRINTER MOTOR DRIVE WITH BACKLASH CONTROL SYSTEM

[75] Inventors: Stephen B. Witte, Poway, Calif.; Damon W. Broder, Austin, Tex.

[73] Assignee: Hewlett-Packard Company, Palo Alto, Calif.

[21] Appl. No.: 236,928

[22] Filed: May 2, 1994

Related U.S. Application Data

[63] Continuation-in-part of Ser. No. 56,229, Apr. 30, 1993, Pat. No. 5,399,039, which is a continuation-in-part of Ser. No. 876,942, May 1, 1992, Pat. No. 5,329,295.

[51] Int. Cl.[6] ..... B41J 19/78

[52] U.S. Cl. ..... 400/577; 347/104; 74/409

[58] Field of Search ..... 74/409, 411.5, 74/440; 400/328, 569, 577; 347/101, 104

[56] References Cited

U.S. PATENT DOCUMENTS

| | | | |
|---|---|---|---|
| 3,105,731 | 10/1963 | Bertrang | 74/409 |
| 3,365,723 | 1/1968 | Spormann | 74/409 |
| 3,851,582 | 12/1974 | Saueressig et al. | 101/181 |
| 3,854,224 | 12/1974 | Yamaji et al. | 34/77 |
| 4,313,684 | 2/1982 | Tazaki et al. | 400/322 |
| 4,340,893 | 7/1982 | Ort | 346/1.1 |
| 4,358,192 | 11/1982 | Goldberg et al. | 354/299 |
| 4,385,826 | 5/1983 | Itoh | 355/14 FU |
| 4,414,755 | 11/1983 | Ericsson | 34/4 |
| 4,490,728 | 12/1984 | Vaught et al. | 346/1.1 |
| 4,661,824 | 4/1987 | Kuge | 346/70 PH |
| 4,679,673 | 7/1987 | Yamaoka et al. | 192/21 |
| 4,712,172 | 12/1987 | Kiyohara et al. | 346/1.1 |
| 4,728,963 | 3/1988 | Rasmussen et al. | 346/25 |
| 4,751,528 | 6/1988 | Spehrley, Jr. et al. | 346/140 R |
| 4,780,078 | 10/1988 | Masui | 432/60 |
| 4,885,959 | 12/1989 | Shinjo et al. | 74/409 |
| 4,914,562 | 4/1990 | Abe et al. | 346/140 R |
| 4,928,112 | 5/1990 | Hock et al. | 346/134 |
| 4,952,781 | 8/1990 | Kozaiku | 219/469 |
| 4,970,528 | 11/1990 | Beaufort et al. | 346/25 |
| 4,979,404 | 12/1990 | Nakata et al. | 74/409 |
| 4,982,207 | 1/1991 | Tunmore et al. | 346/138 |
| 5,015,104 | 5/1991 | Sato | 74/409 |
| 5,021,805 | 6/1991 | Imaizumi et al. | 346/76 |
| 5,041,846 | 8/1991 | Vincent et al. | 346/25 |
| 5,055,861 | 10/1991 | Murayama et al. | 346/140 R |
| 5,060,572 | 10/1991 | Waizmann | 101/424.1 |
| 5,117,562 | 6/1992 | Dulay et al. | 34/48 |
| 5,130,726 | 7/1992 | Fukushima et al. | 346/140 R |
| 5,158,381 | 10/1992 | Inomata et al. | 400/605 |
| 5,257,543 | 11/1993 | Fogelberg | 74/409 |
| 5,357,858 | 10/1994 | Guaraldi et al. | 74/409 |

OTHER PUBLICATIONS

IBM Technical Disclosure Bulletin, "All-Plastic Anti-Backlash Gear," J. W. Mink et al. vol. 26, No. 1, Jun. 1983, pp. 296, 297.

*Primary Examiner*—David A. Wiecking

[57] ABSTRACT

A backlash control system for a printer medium drive system having a motor-driven gear train for driving medium-engaging rollers. Pinion gears mounted on the motor drive shaft mesh with a main gear and a tension gear, mounted in turn on a main drive and a tension roller. An anti-backlash spring device includes pinch fingers which exert a pinch force on the main and tension gears. The pinch fingers are mounted at ends of a horizontal spring beam secured at an intermediate pivot point. As the motor turns to drive the print medium forward, the pinch force results in bowing of the horizontal beam, tending to exert a restoring force on the main and tension gears. As the motor direction is reversed and stopped, the restoring force results in the main and tension gears being pulled backwards to keep the gear teeth meshed tightly to the pinion gear teeth. The pinch fingers also exert a thrust load axially against the main drive and tension gears.

34 Claims, 7 Drawing Sheets

PRINTER MOTOR DRIVE WITH BACKLASH CONTROL SYSTEM

RELATED APPLICATIONS

This application is a continuation-in-part of application Ser. No. 08/056,229, filed Apr. 30, 1993, now U.S. Pat. No. 5,399,039 issued Mar. 21, 1995 IMPROVED MEDIA CONTROL AT INK-JET PRINT ZONE, by R. Giles et al., which in turn is a continuation-in-part of application Ser. No. 07/876,942, filed May 1, 1992, now U.S. Pat. No. 5,329,295 issued Jul. 12, 1994 PRINT ZONE HEATER SCREEN FOR THERMAL INK-JET PRINTER, by T. Medin et al. The entire contents of these referenced applications are herein incorporated by reference.

This application is related to application Ser. No. 08/056,287, filed Apr. 30, 1993, PRINT AREA RADIANT HEATER FOR INK-JET PRINTER, by S. I. Moore et al.; application Ser. No. 08/056,288, filed Apr. 30, 1993, now U.S. Pat. No. 5,406,316 issued Jul. 11, 1995 entitled AIR-FLOW SYSTEM FOR INK-JET PRINTER, by W. H. Schwiebert et al.; application Ser. No. 08/055,609, filed Apr. 30, 1993, Attorney Docket No. 1093142-1, DUAL FEED PAPER PATH FOR INK-JET PRINTER, by R. R. Giles et al.; application Ser. No. 08/056,449, filed Apr. 30, 1993, MULTI-PURPOSE PAPER PATH COMPONENT FOR INK-JET PRINTER, by G. G. Firl, et al; and application Ser. No. 08/056,039, filed Apr. 30, 1993, now U.S. Pat. No. 5,406,321 issued Apr. 11, 1995 PAPER PRECONDITIONING HEATER FOR INK-JET PRINTER, by W. H. Schwiebert et al. The entire contents of commonly assigned, copending application Ser. No. 08/056,693, filed Apr. 30, 1993, TRACTION SURFACE FOR PRINT MEDIUM FEED OF HEATED PRINTER, by D. C. Burney et al., is incorporated herein by this reference.

BACKGROUND OF THE INVENTION

The present invention relates to the field of ink-jet printers.

With the advent of computers came the need for devices which could produce the results of computer generated work product in a printed form. Early devices used for this purpose were simple modifications of the then current electric typewriter technology. But these devices could not produce graphics or multicolored images, nor could they print as rapidly as was desired.

Numerous advances have been made in the field. The impact dot matrix printer is still widely used, but is not as fast or as durable as required in many applications, and cannot easily produce high definition color printouts. The development of the thermal ink-jet printer has solved many of these problems. Commonly assigned U.S. Pat. No. 4,728,963, issued to S. O. Rasmussen et al., describes an example of this type of printer technology.

Thermal ink-jet printers employ a plurality of resistor elements to expel droplets of ink through an associated plurality of nozzles. In particular, each resistor element, which is typically a pad of resistive material about 50 μm by 50 μm in size, is located in a chamber filled with ink supplied from an ink reservoir comprising an ink-jet cartridge. A nozzle plate, comprising a plurality of nozzles, or openings, with each nozzle associated with a resistor element, defines a part of the chamber. Upon the energizing of a particular resistor element, a droplet of ink is expelled by droplet vaporization through the nozzle toward the print medium, whether paper, fabric, or the like. The firing of ink droplets is typically under the control of a microprocessor, the signals of which are conveyed by electrical traces to the resistor elements.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column on the ink cartridge multiplied times the distance between nozzle centers. After each such completed movement or swath, the medium is moved forward the width of the swath, and the ink cartridge begins the next swath. By proper selection and timing of the signals, the desired print is obtained on the medium.

The present invention is directed to the problem of controlling errors in the medium drive system due to gear backlash. The medium drive system typically includes a motor drive element, typically a stepper motor, which is connected to a drive motor through a gear train. Because it is essential for high print quality that the movement of the print medium through the print area be precisely controlled, backlash in the drive system can introduce serious accuracy errors.

This invention provides a solution to the problem of backlash in a printer medium drive system.

SUMMARY OF THE INVENTION

A drive system having backlash control is described and comprises first and second gears arranged in a gear train wherein teeth of the first gear engage in meshing relationship with teeth of the second gear as the first gear is rotated. The drive system includes means for driving said the gear and controller means for controlling the operation of the drive means to nominally start and stop the driving means. In accordance with the invention, the drive system further includes means for controlling gear backlash, comprising means for applying a pinch force to opposed surfaces of the second gear at a pinched area spaced from a center axis of the second gear, the pinch force applying means cantilevered at an end of an elongated spring beam. As the first gear rotates in a first direction, the second gear rotates in a second direction, and friction between the pinch force applying means and the opposed gear surfaces results in a reaction force applied at the end of the spring beam which deflects the beam from a nominal alignment, the deflected beam applying a restoring force on the second gear tending to rotate the gear in the first direction and keep the teeth of the first and second gears in mesh as the first gear stops and reverses direction of rotation from the first to the second direction.

In a preferred embodiment, the pinch force applying means comprises a pair of tensioned grip fingers biased to a pinch point at tips thereof. The fingers are disposed to contact the opposed surfaces of the second gear. A U-shaped member defines the fingers.

The means for controlling gear backlash further includes means for applying a thrust load against the second gear. The means for applying a thrust load comprises one of the grip fingers, which is bent away from an unsprung pinch point by contact with one of the second gear surfaces, thereby applying the thrust load against the one surface.

In the preferred embodiment, the drive system comprises a medium advance drive system in an ink-jet printer, thereby enhancing the accuracy of the advancing system. The drive system is motor-driven, with the first gear being a pinion gear mounted on a motor shaft, and the second gear being a drive gear mounted on a roller drive shaft. The backlash control system ensures that the teeth of the pinion and drive gears are in mesh at all times, even when the motor is stopped and reversed directions for a short distance. The backlash control system is also used on the printer tension gear train, used to drive an output medium tension roller.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
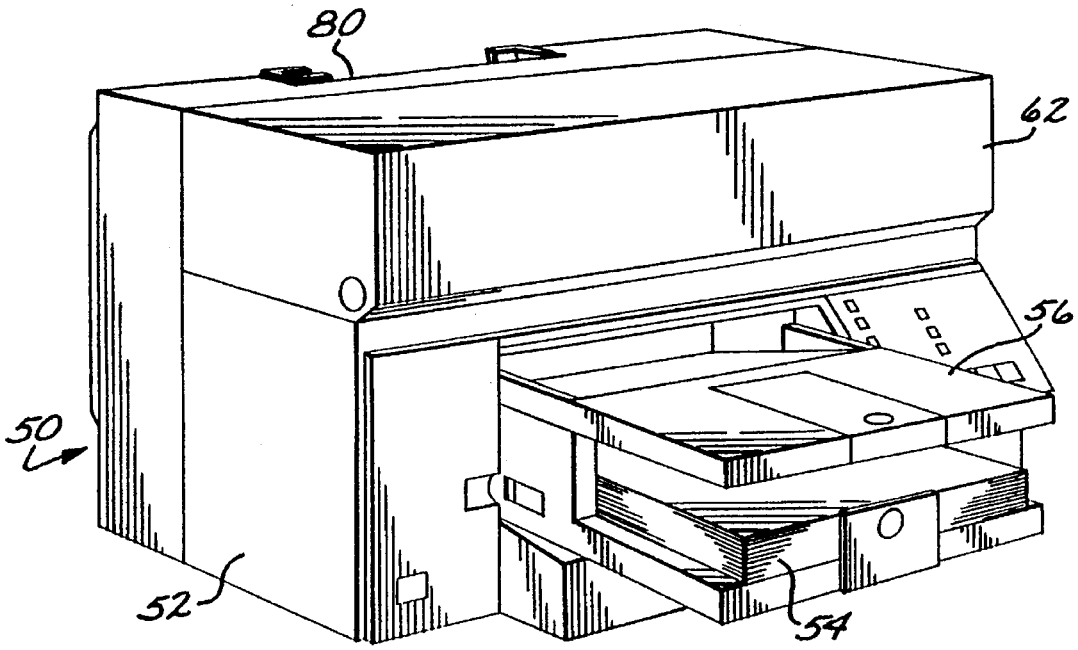
FIG. 1 is an isometric view of a color printer embodying the present invention, showing the front of the printer.
Figure 2:
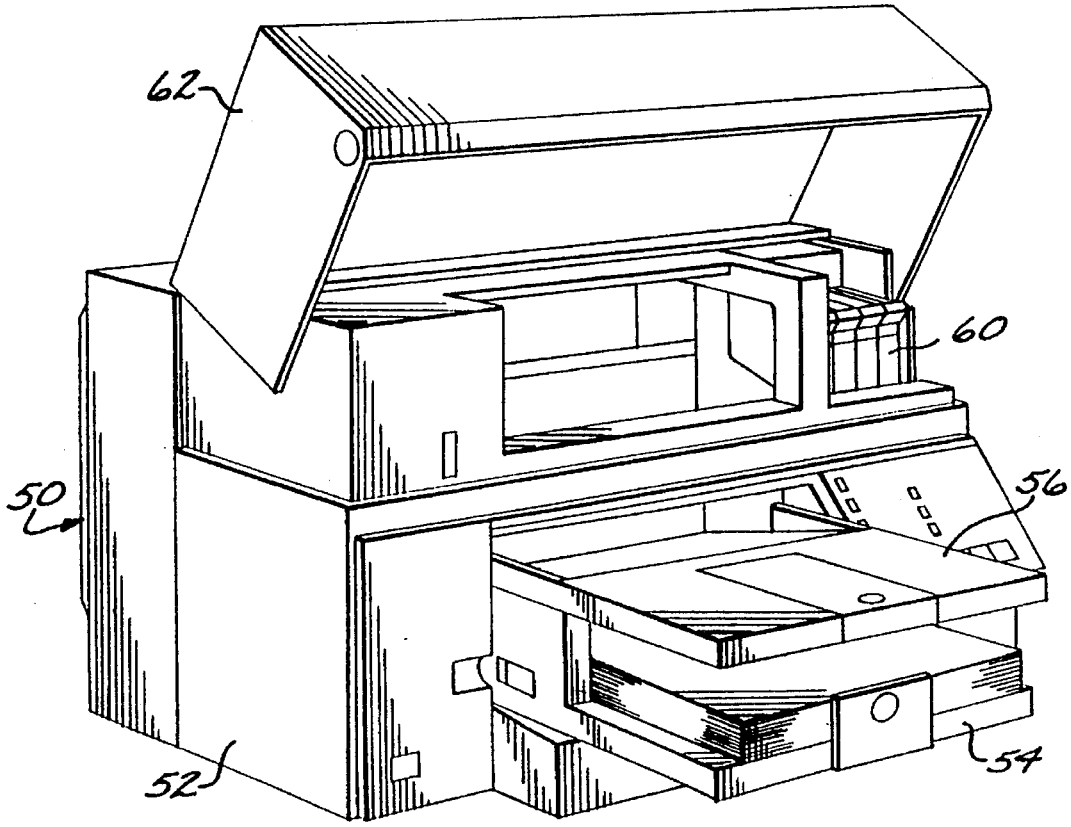
FIG. 2 is another isometric view of the color printer of FIG. 1, showing the top front cover in an open position.

External features of a color printer 50 embodying the invention is shown in the isometric views of FIGS. 1 and 2. The printer 50 comprises a housing 50 supporting an input media tray 54 and an output tray 56. The print media, e.g., sheet paper, is stacked in the input tray 54, and withdrawn by a pick mechanism, as is well known in the art. While it is to be understood that other types of print media may be used in the printer 50, for the sake of description herein the medium will be described as paper. The paper is driven through a paper path, to be described in more detail below, which reverses the direction of the paper and leads to the output tray 56. The paper is preheated by a preheater element which defines a portion of the medium path. The preheater drives moisture out of the paper and elevates the paper temperature, thereby conditioning the paper for the ink-jet printing which occurs at the printer print zone. The paper drive mechanism drives the paper through the print area, which has a print area heater for heating the paper to dry the ink very rapidly once the ink contacts the paper. An airflow system is provided to draw air past the print zone, clearing ink vapor and excess ink droplets away from the print zone. The airflow system includes ductwork which also draws air past electronic components to provide cooling, and to actively ventilate the heaters to prevent runaway temperature conditions.

This exemplary embodiment includes four ink cartridges 60 mounted on a carriage which is driven along a carriage axis extending orthogonally to the direction of paper travel past the print zone. The cartridges are visible in FIG. 2, in which the front top cover 62 of the printer is shown in an open position. In a typical application, the cartridges each contain ink of a different color, e.g., black, cyan, magenta and yellow, permitting full color printing operations. The inks are water-based in this exemplary embodiment.

Figure 3:
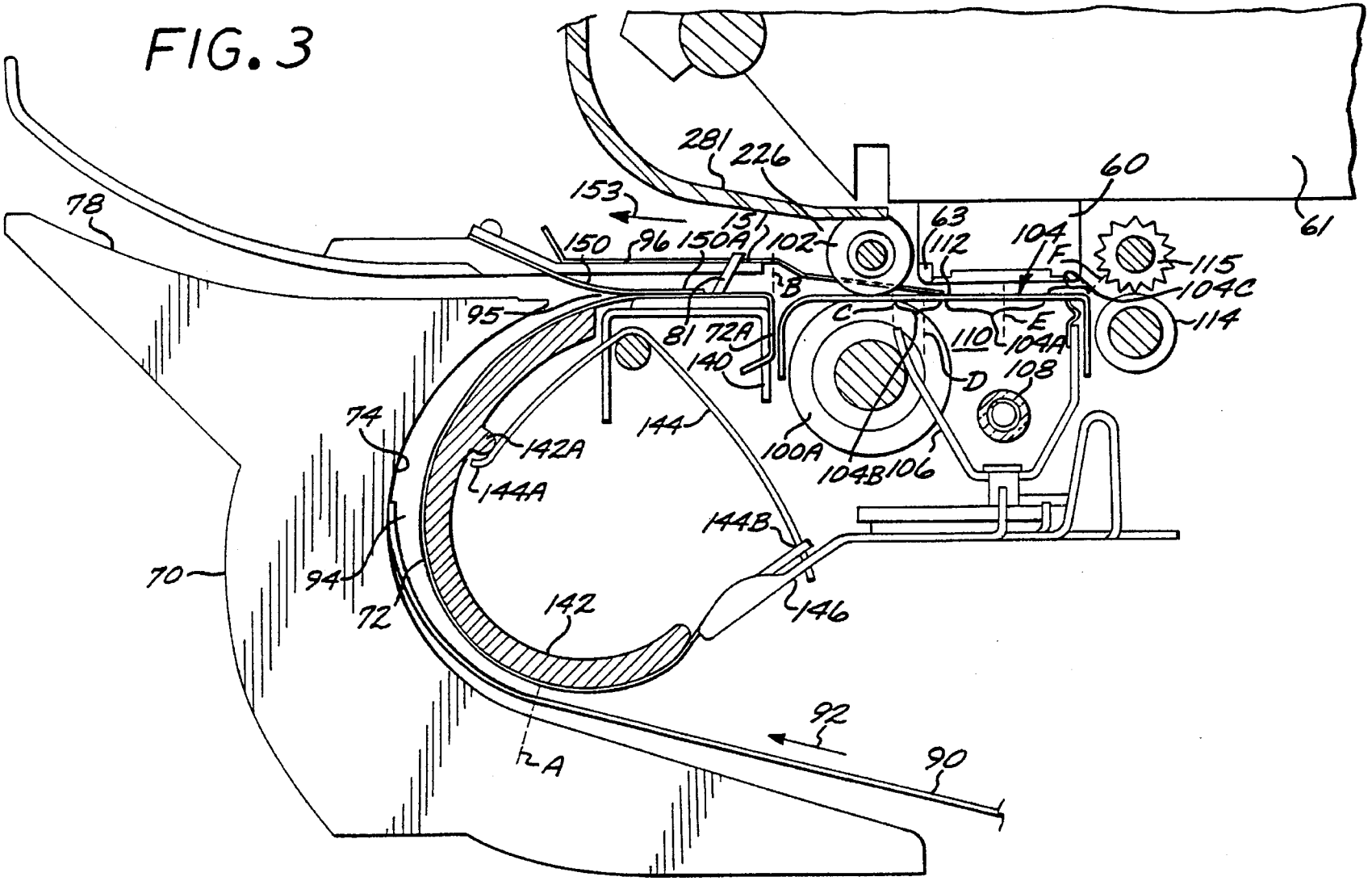
FIG. 3 is a cross-sectional view taken along a portion of the medium feed path of the printer of FIG. 1.

Referring now to FIG. 3, a major portion of the paper path through the printer 50 is illustrated in cross-section. The paper 90 is picked from the input tray 54 and driven into the paper path in the direction of arrow 92. The paper 90 enters the slot 94 defined by the curved surface 74 of member 70 and the preheater 72, contacts the curved contour 74 defined by the ribs 74A, and is guided around and in contact with the curved surface defined by the preheater 72. A guide 96 is secured above the outlet of the slot 94, and guides the paper to complete the reversal of direction, such that the paper is now headed 180 degrees from the direction its leading edge faced when picked from the input tray.

A flexible bias guide 150 is positioned above the upper guide 140 and preheater 72, so that one edge is in contact with the preheater 72, when no paper is present. The bias guide forces the paper against the preheater 72 to ensure effective thermal energy transfer. The leading edge of the preheated paper 90 is then fed into the nip between drive roller 100 and idler roller 102. With the paper being held against the heater screen 104 by a paper shim 151, the paper 90 is in turn driven past the print area 104, where radiant heat is directed on the undersurface of the paper by reflector 106 and heater element 108 disposed in the heater cavity 110 defined by the reflector. The screen 112 is fitted over the cavity 110, and supports the paper as it is passed through the print zone 104, while at the same time permitting radiant and convective heat transfer from the cavity 110 to the paper 90.

At the print area, ink-jet printing onto the upper surface of the paper occurs by stopping the drive rollers, driving the cartridge carriage 61 along a swath, and operating the ink-jet cartridges 60 to print a desired swath along the paper surface. After printing on a particular swath area of the paper is completed, the drive rollers 100 and 114 are actuated by a stepper motor 162, and the paper is driven forward by a swath length, and swath printing commences again. After the paper passes through the print area 114 it encounters output roller 114, which is driven at the same rate as the drive roller 100, and propels the paper into the output tray 56.

Referring to FIG. 3, the area of the paper path between "A" and "B" is the preheated portion of the paper path. The area between "B" and "C" is an unheated portion of the paper path. The print zone 104A at which ink-jet printing by cartridges 60 occurs is centered at "E". The area 104B between "C" and "D" is heated by element 108, and represents an additional preheating zone adjacent the print zone at E. The area 104C between "E" and "F" is also heated by element 108, and is an area of post-print-heating of the medium.

Figure 4:
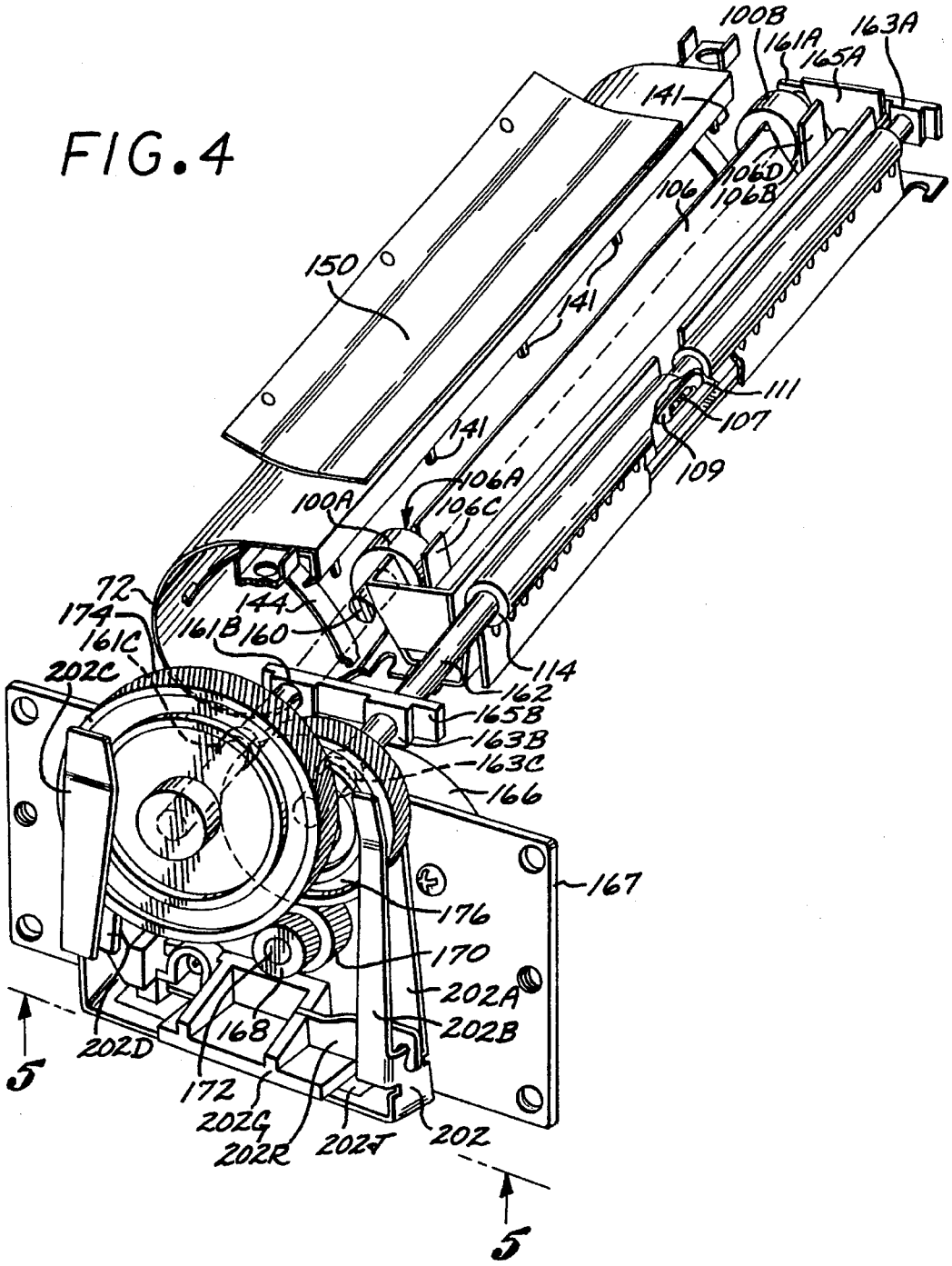
FIG. 4 is an isometric view of drive train elements comprising the medium drive system of the printer of FIG. 1.
Figure 5:
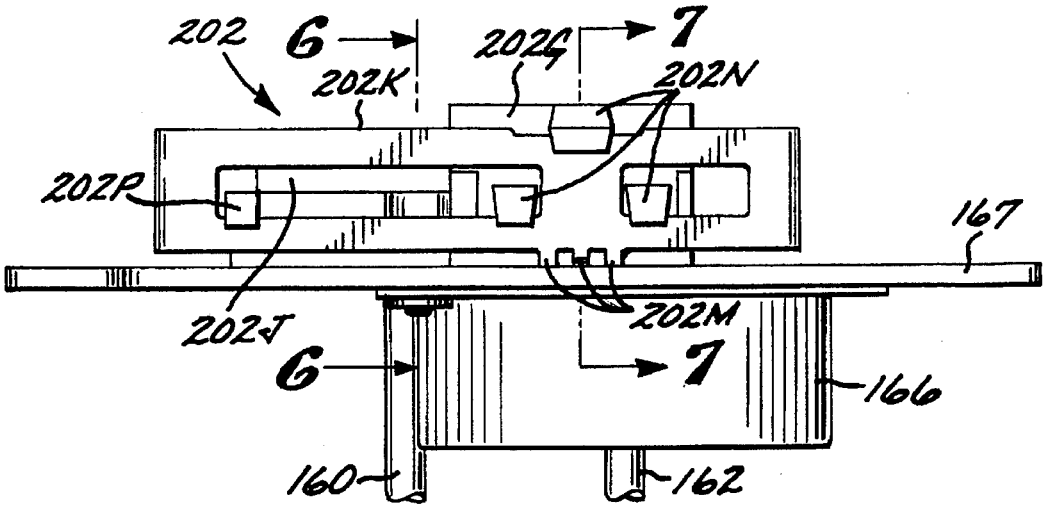
FIG. 5 is a bottom view of the drive train elements indicated by line 5–5 of FIG. 4.

FIG. 4 illustrates the arrangement of the paper drive and heating elements in an isometric view. For clarity, the screen 112 is not shown in this view. Drive rollers 100A and 100B are mounted for rotation on drive shaft 160. Tension roller 114 is mounted on tension shaft 162. Each shaft has a relatively small diameter, 0.250 inches in the exemplary embodiment. Such shafts, fabricated of stainless steel and with the relatively small diameter, are relatively non-rigid in this arrangement. In order to provide stability and the shaft stiffness required for accurate operation, each shaft is mounted on three bearings. Thus, shaft 160 is mounted on bearings 161A, 161B and 161C. Shaft 162 is mounted on bearings 163A, 163B and 163C. The bearings are secured on respective connector plates, e.g., 165A and 165B, so that the bearings self-align the relative positions of the shifter 160 and 162.

The rollers 100A and 100B in this exemplary embodiment are substantially larger in diameter than the drive shaft 160, e.g., 0.713 inches in diameter, and are fabricated of a heat-resistant, grit-covered material. With the rollers 100A and 100B larger than the diameter of the shaft 160, the effective heating area defined by the reflector opening can be maximized, since the rollers can be made to intrude into the cavity space at the edges of the cavity 110, but without reducing the area of the reflector opening between the rollers. Thus, in this embodiment, slots 106A and 106B are fashioned in the reflector 106 by cutting the reflector wall and bending the tabs 106C and 106D inwardly. The idler roller 102 has a similar configuration to driver roller 100, i.e., a small diameter shaft supporting two larger-diameter rollers. Idler starwheel 115 has a similar configuration to tension roller 114. As a result, the heating area provided by the heater assembly comprising the reflector 106 need not be sacrificed, while at the same time the handoff distance between the drive and tension rollers 100A, 100B and 114 can be kept small. Minimizing the paper handoff distance between the drive and tension rollers contributes to accuracy in paper advancement, since it minimizes the medium area over which the drive and tension rollers are not simultaneously acting. Moreover, no additional output rollers or mechanisms, other than the tension roller, are required to stack the media in the output tray 56.

In a preferred embodiment, the driver rollers 100A and 100B engage the paper adjacent opposed edges thereof. The rollers have a width dimension of 0.365 inches in this example, smaller than the margin width. The print area is forward of the drive rollers 100A and 100B, so that the drive rollers do not interfere with printing operations.

The paper drive mechanism of the printer 50 further comprises a motor 166 having two pinion gears 168 and 170 of different sizes mounted on the motor shaft 172. The pinion gears 168 and 170 directly drive the respective drive and tension shafts 160 and 162 through a drive gear 174 and a tension gear 176. The drive gear is slightly larger than the tension gear; the sizes of the pinion gears are selected with the sizes of the drive and tension gears to produce substantially equal drive and tension roller rotation speeds. All gears have helical gear teeth to minimize drive train noise. In this embodiment, the gears 174 and 176 are fabricated of an engineering plastic. The gears 170 and 172 are hobbed from a metal such as brass.

The motor 166 is mounted inboard of the shaft ends, to reduce the required width dimension along the carriage axis. The motor 166 in this exemplary embodiment is a permanent magnet stepping motor.

In accordance with this invention, and as more particularly illustrated in FIGS. 5–10, an anti-backlash device 202 is provided to prevent backlash movement of the gear train, thereby improving the accuracy and control of media advancement and positioning. The purpose of the device 202 is to keep the teeth of the respective drive and tension gears 174 and 176 meshed tightly together with teeth of the corresponding pinion gears 168 and 170 even if the motor 166 backs up slightly. If the gears were to become unmeshed, the resultant accuracy error would be significantly greater than all other error sources combined. The device 202 includes elements which pinch the gears, adding friction so that when the motor 166 stops and backs up, the gears follow it backwards, thereby keeping the gear teeth meshed together.

The device 202 provides the anti-backlash function to each pair of meshed gears 168, 174 and 170, 176. The device 202 provides three separate spring functions for each gear pair. For example, the first spring applies a controlled pinch force on the drive gear 174. The second spring is stretched forward every time the motor moves forward and provides the restoring force or anti-backlash function. The third spring provides a thrust load that keeps the drive gear 174 pushed against the motor mounting plate 167. Similar spring functions are applied to the other gear pair 170, 176.

The device 202 includes a first pair of pinch spring fingers 202C and 202D, which apply a pinch force on the gear 174, and therefore provide the first spring function. The fingers 202C and 202D are defined by a U-shaped structure 202E, extending from an upturned end of a horizontal beam structure 202K. A second pair of pinch spring fingers 202A and 202B apply a pinch force on the gear 176, and are defined by a U-shaped structure 202F from the other upturned end of the horizontal beam structure 202K. Thus, the U-shaped structures are cantilevered at opposite ends of the horizontal beam structure. These structures 202E, 202F and 202K are, in this exemplary embodiment, fabricated as a unitary element from a thin sheet of half-hardness stainless steel. The beam member 202K is secured at an area between the corners 202H, 202I by a plastic bracket 202G. The secured area, generally between screw fastener 202L and tab 202N (FIG. 8) acts as a pivot area 202S about which the ends of the beam structure 202K flexes. In this embodiment, the horizontal beam member 202K has an open window 202J formed therein, permitting tabs 202N and tab 202P comprising the mounting bracket 202G to be received therein. The bracket includes grooves which receive edgewise portions of the horizontal beam to secure its position, with the tabs 202N fitting over the beam structure 202K.

The plastic gears 174 and 176 have ridges defined therein, e.g., ridges 174A and 176A, on each side thereof to provide a gear material thickness at the pinch point between the pinch fingers which is equal to the thickness of the gear teeth. To make a plastic molded gear having a uniform thickness is impractical, due to shrinkage effects, and so the ridges 174A, 176A provide the thickness required at the pinch point. This thickness ensures that the pinch force applied by the pinch fingers will be sufficient to tension the spring to apply the anti-backlash force.

Figure 6:
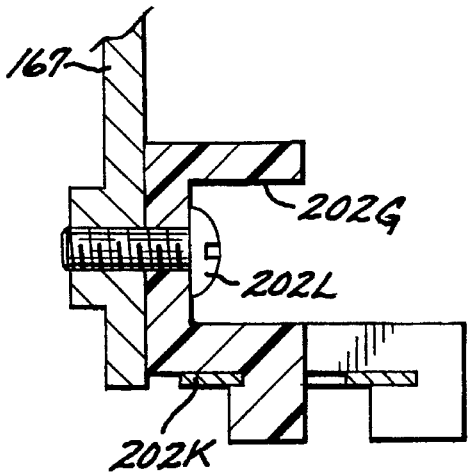
FIG. 6 is a cross-sectional view taken along line 6—6 of FIG. 5.
Figure 7:
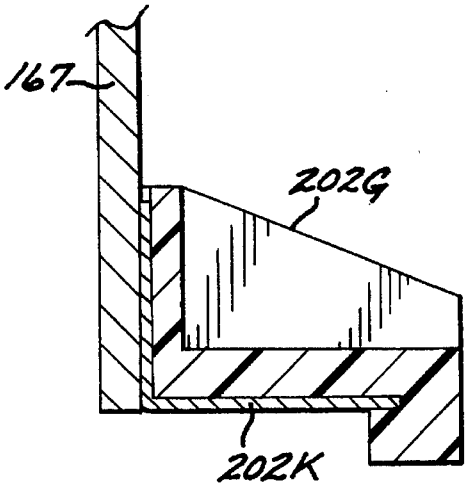
FIG. 7 is a cross-sectional view taken along line 7—7 of FIG. 5.

The mounting bracket 202G and horizontal beam structure are in turn secured to the mounting plate 167 by threaded fastener 202L (FIG. 6). A pair of standoff tabs 202M extend from the horizontal beam structure and keep that structure from being forced against the mounting plate 167 as the threaded fastener is secured, thereby clamping the structure 202K at the secured area 202S. This permits the horizontal beam to deflect and flex in response to the reaction forces applied by the pinching fingers as the gears 174 and 176 turn even after the fastener 202L has been tightened in place.

The mounting bracket 202G further includes a plastic guide member 202R attached thereto. An end of the guide member fits over an edge of the U-shaped member 202F to act as a horizontal movement restraint to prevent the member 202F from riding out on teeth of the gear 176.

Figure 8:
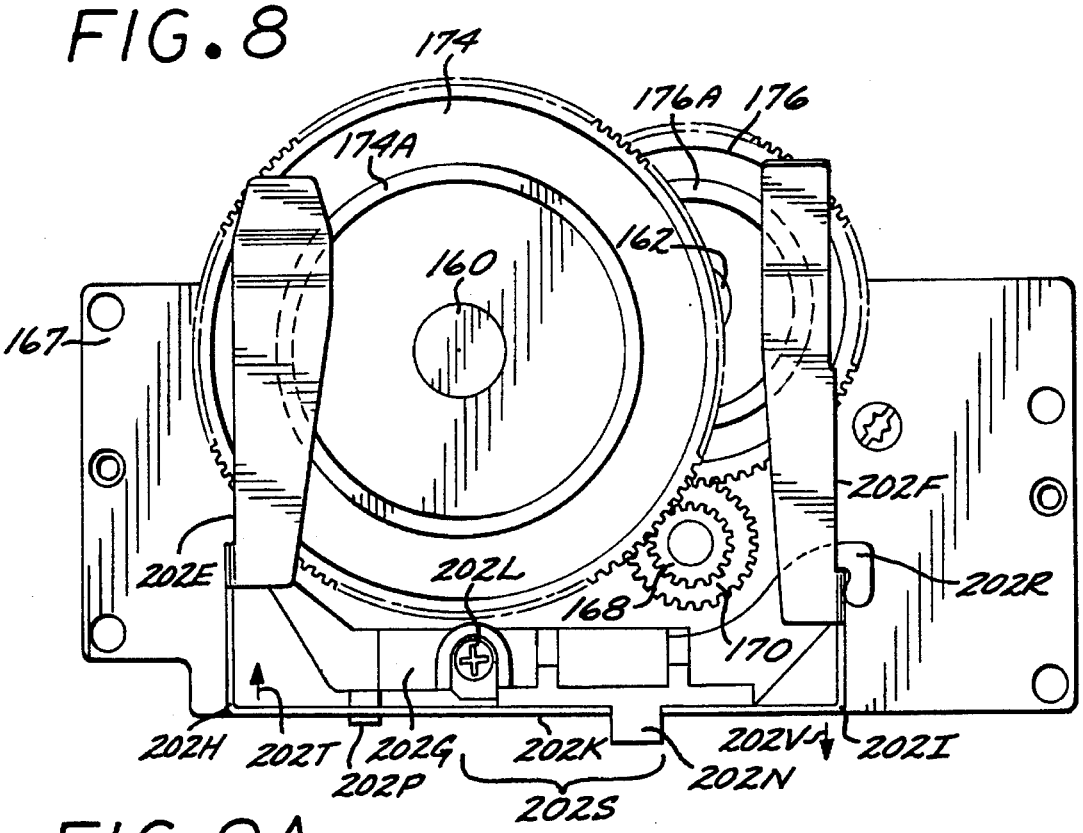
FIG. 8 is a side view of the drive train system, including the anti-backlash device.
Figure 9A:
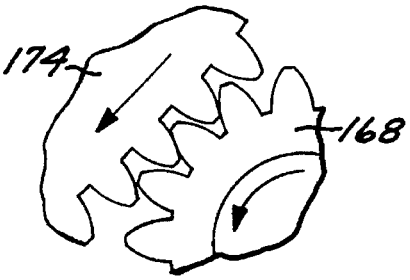
FIGS. 9A, 9B, 9C and 9D illustrate the pinion gear and drive gear in various stages of operation, to illustrate the function of the anti-backlash device.

The anti-backlash force is applied to the gear 174 by the flexing of the horizontal beam 202K in reaction to the drag caused by the frictional engagement of the fingers 202C and 202D on the drive gear 174. When the gears move the print medium forward, the motor pinion gear 172 moves counterclockwise and the main drive gear moves clockwise (FIG. 9A). As the main gear 174 moves clockwise, the friction caused by the pinch fingers 202C and 202D results in the corner 202H of the spring being lifted up about 1–2 mm in this exemplary embodiment, in the direction of arrow 202T (FIG.8). Because the pinch force applied to the tension gear 176 by fingers 202A and 202B is on the opposite side of the gear center from the force applied to the gear 174, the pinch force results in the corner 202I of the horizontal beam 202K being forced downwardly slightly, in the direction of arrow 202V (FIG. 8). The formerly straight horizontal beam is now bowed to provide the anti-backlash force. This particular embodiment is designed to optimize the anti-backlash force applied to the main drive gear 174, and so the length of the moment arm for the pinch member 202E is somewhat longer than the moment arm for the pinch member 202F, resulting in greater flexing of the corner 202H as the drive train rotates.

Figure 9C:
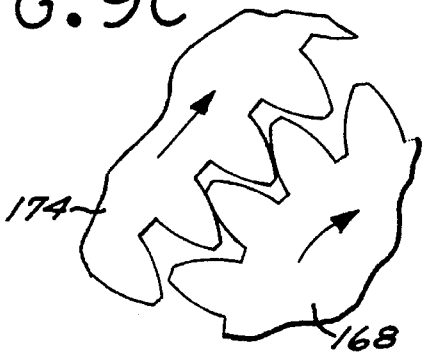
Figure 9B:
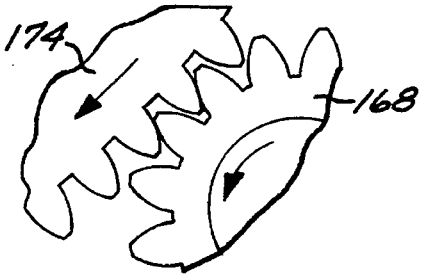
Figure 9D:
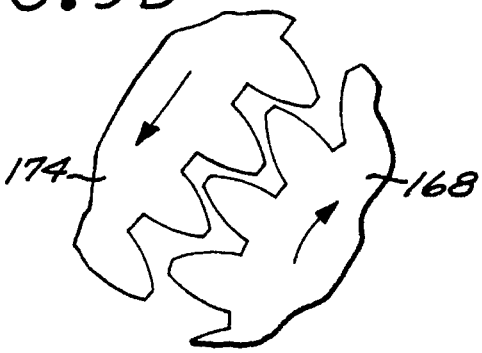

Consider that the motor 166 has been moving in the forward direction so that the pinion gears rotate counterclockwise, and the drive gear 174 and tension gear 176 rotate clockwise. FIG. 9A illustrate the pinion gear 168 and drive gear 174 in isolation. Now assume that the motor 166 is slowing down, but still moving forward, the condition illustrated in FIG. 9B. FIG. 9C shows the condition that the motor 166 has reversed directions, i.e., backed up, and then stopped, and the anti-backlash spring has operated successfully to keep the teeth of gears 168 and 174 tightly meshed together, by pulling the gear 174 in the counterclockwise direction against the pinion gear 168. In this embodiment, the motor direction is not reversed substantially to reverse the direction of print medium movement during printing operations. However, control over the stepper motor may result in relatively small incremental shaft reversal forces, e.g., momentary forces due to position control overshoots. (During print medium conditioning prior to commencement of printing, there may be reversal in the drive direction to initially position the leading edge first over the main print heater, and then later over the preheater, but these movements do not require precision of the degree necessary for the advancement movement during print operations). Thus, the tensioned spring resulting from upward deflection of corner 202H applies a downward force on the edge of the gear 174 pinched between the fingers 202C and 202D, in turn pulling the gear 174 in the counterclockwise direction. In contrast, FIG. 9D shows the condition where the motor backs up slightly and stops, and there is no anti-backlash spring force. In this case, the teeth of the gears 168 and 174 have become unmeshed, because the drive gear 174 continued to move forward while the motor was backing up. FIG. 9D illustrates a failure condition, with high accuracy errors in the operation of the medium drive system.

Figure 10B:
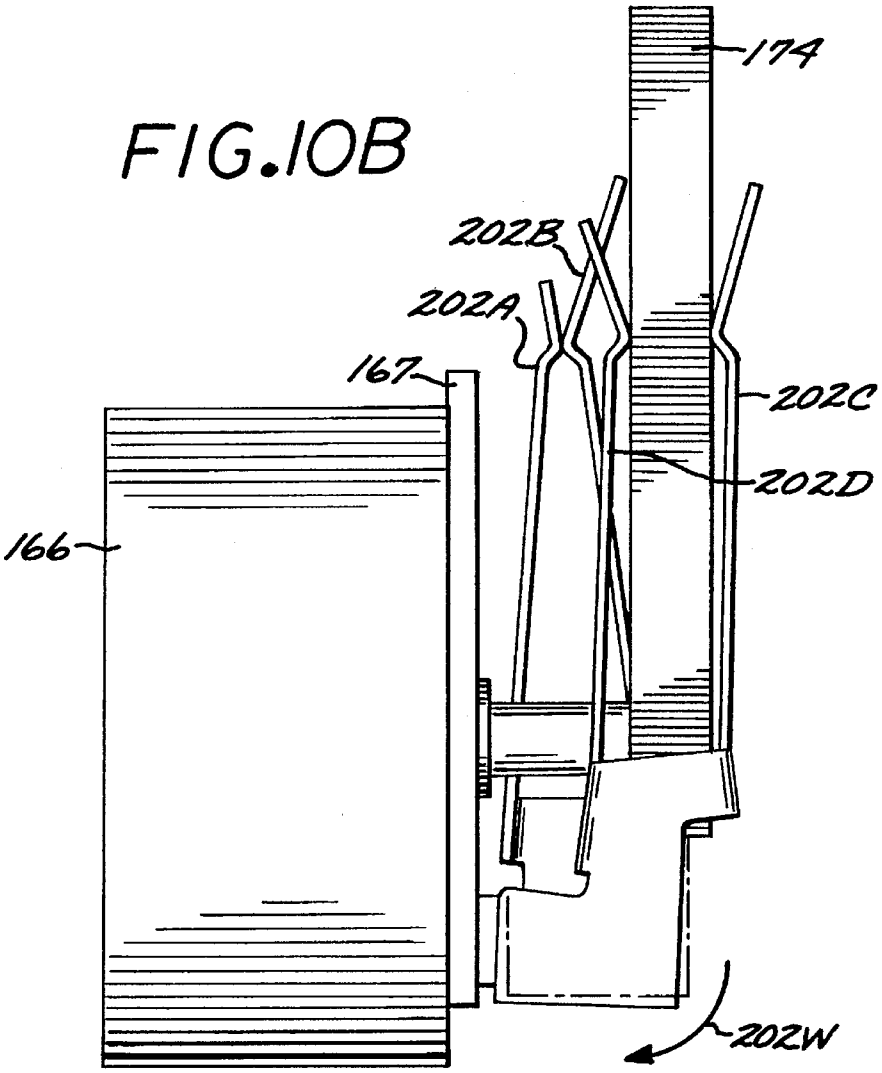
FIGS. 10A and 10B show in side view the spring fingers of the anti-backlash device respectively in an unsprung condition and in the condition when the drive gear is in place, illustrating how a thrust load is applied axially against the drive and tension gears.
Figure 10A:
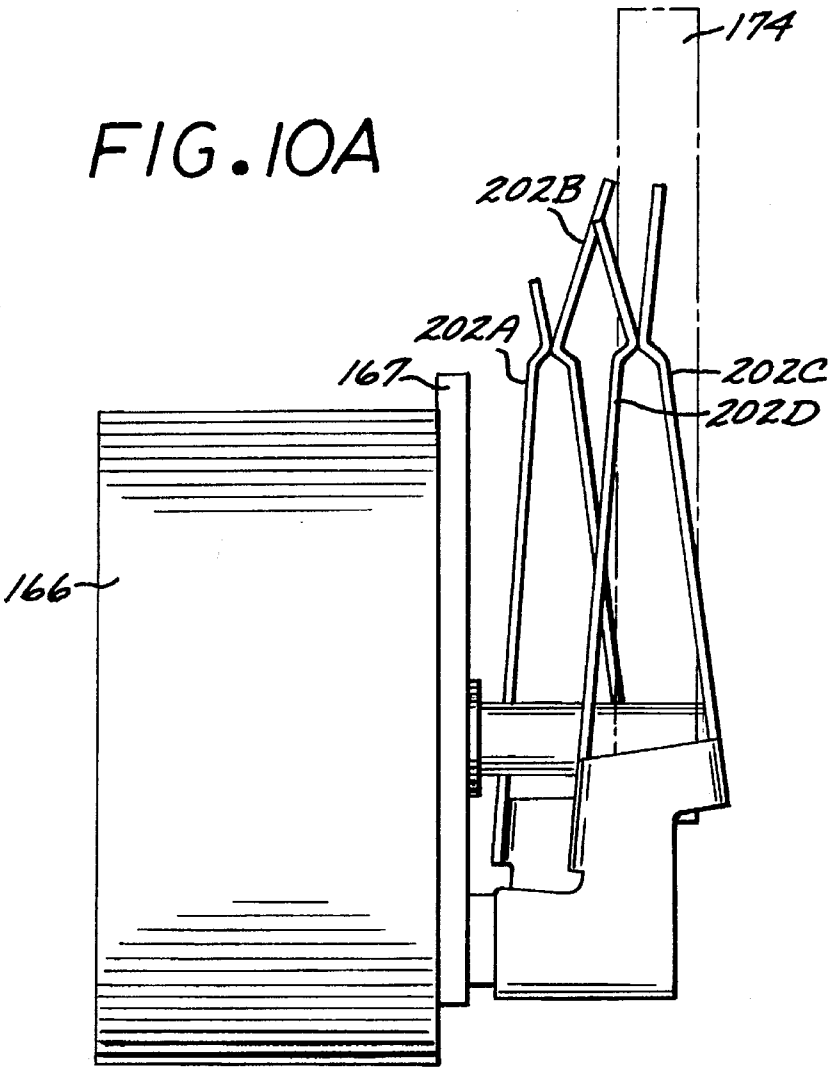

The third spring function is to exert a thrust load to keep the drive and tension gears 174 and 176 pushed against the motor mounting plate 167. This is achieved by constructing the pinch fingers and horizontal beam element so that the unsprung pinch point of each pair of pinch fingers (without the gears being mounted in position) is closer to the motor mounting plate than the nominal pinch point when the gears are mounted between the fingers. This is shown in FIGS. 10A and 7B. FIG. 10A shows the unsprung condition when the fingers are not bent apart and separated by the gears. In this case, the horizontal beam 202H is substantially horizontal. FIG. 10B shows the condition when the gears are in place, and the outer spring fingers 202B and 202C are deflected away from the mounting plate to accommodate the thickness of the gears 174 and 176, e.g., on the order of 4 mm in an exemplary embodiment. This results in the twisting of the horizontal beam 202H in the direction of the arrow 202W, as shown in exaggerated fashion in FIG. 10B. The deflection of the outer fingers and the twisting of the horizontal beam structure results in a thrust load tending to push the main drive and tension gears 174 and 176 toward the mounting plate 167.

Figure 11:
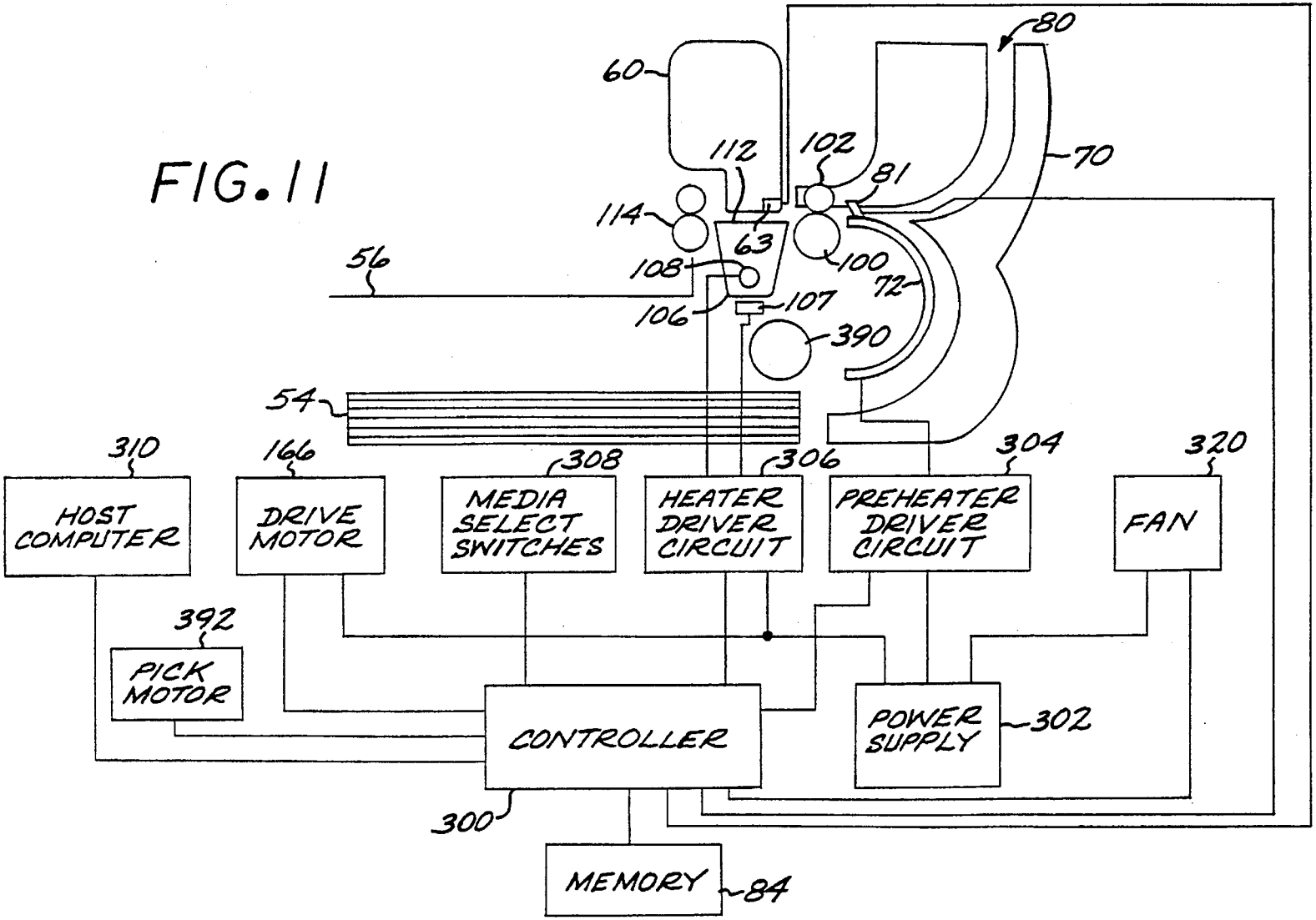
FIG. 11 is a schematic illustration of the printer paper path components and the control and drive elements therefore.

FIG. 11 is a schematic block diagram illustrating the control elements associated with the paper path through the printer 50. Illustrated here in a schematic form are the paper trays 54 and 56, the pick roller 390 which picks sheets from the input tray and delivers the sheet into the paper path between the preheater 72 and the component 70, and up into the nip between the drive roller 100 and the idler roller 102. The pick roller 290 is driven by pick motor 392. An exemplary ink-jet cartridge 60 is disposed above the print area. The heater element 108 with the reflector 106 is disposed below the print area. A temperature sensing resistor 107 is disposed on a circuit board 109 disposed adjacent an opening in the bottom portion of the reflector 106, and senses the temperature within the cavity 110. A printer controller 300 interfaces with a host computer 310, such as a personal computer or work station, which provide print instructions and print data. The printer 50 further includes media select switches and other operator control switches 308, which provide a means for the operator to indicate the particular type of medium to be loaded into the printer. Alternatively, the host computer signals may specify the particular type of media for which the printer is to be configured. The heater element 108 is powered by drive signals from the drive circuit 306 controlled by the controller 300. The operation of the preheater 72 and fan 320 are also controlled by the controller 300.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink-jet printer having backlash control of a medium advancement system, comprising:

a printhead for ejecting ink droplets onto a print medium in a controlled fashion at a print area;

first drive roller means mounted on a first drive shaft to engage a surface of said medium and drive said medium to said print area, said first roller positioned adjacent an input side of a print area;

second drive roller means mounted on a second drive shaft, said second roller means positioned adjacent said print area at a media output side of said print area for engaging and pulling said medium away from said print area;

a motor having a motor shaft, first and second gears mounted for rotation on said motor shaft, a drive gear mounted on said first drive shaft, and a tension gear mounted on said second drive shaft, said gears comprising a gear train, wherein teeth of said first pinion gear and said drive gear are in meshing relationship and teeth of said second pinion gear and said tension gear are in meshing relationship as said motor drives said first and second pinion gears so as to drive said first and second rollers;

means for controlling gear backlash, comprising first and second means for respectively applying a pinch force to opposed surfaces of said drive gear and to opposed surfaces of said tension gear at respective pinched areas spaced from center axes of said drive and tension gears, said pinch force applying means cantilevered at first and second ends of an elongated spring beam, wherein as said pinion gears rotate in a first direction, said drive gear and said tension gear rotate in a second direction, and friction between said pinch force applying means and said opposed gear surfaces results in a reaction force applied at said first and second ends of said spring beam which deflects said beam from a nominal alignment, said deflected beam applying a restoring force on said drive gear and said tension gear tending to rotate said gears in said first direction and keep said teeth of said first pinion gear and said drive gear in mesh and teeth of said second pinion gear and said tension gear in mesh as said motor stops and reverses direction of rotation from said first to said second direction.

2. The printer of claim 1 wherein said pinch force applying means comprises first and second pairs of tensioned grip fingers biased to a pinch point at tips thereof, and wherein said first pair of fingers are disposed to contact said opposed surfaces of said drive gear, and said second pair of fingers are disposed to contact said opposed surfaces of said tension gear.

3. The system of claim 2 wherein said first and second pinch force applying means each comprises a U-shaped member defining said grip fingers.

4. The system of claim 3 wherein said U-shaped member defines a spring element biased to provide said pinch force.

5. The system of claim 1 wherein said spring beam comprises a thin metal beam element.

6. The system of claim 1 wherein said means for controlling gear backlash further includes means for applying thrust load against said drive gear and said tension gear.

7. The system of claim 1 wherein said pinch force applying means comprises first and second pairs of tensioned grip fingers disposed to contact said opposed surfaces of said drive gear, said second pair of fingers are disposed to contact said opposed surfaces of said tension gear, and wherein a first finger of said first pair is biased toward a first unsprung pinch point, a first finger of said second pair is biased toward an unsprung second pinch point, and wherein said means for applying a thrust load comprises said first grip finger of each pair, said first finger being bent away from said first unsprung pinch point by contact with one of said drive gear surfaces, said first finger of said second pair being bent away from said second unsprung pinch point by contact with one of said tension gear surfaces, and thereby applying said thrust load against said one surface of said respective gears.

8. The drive system of claim 1 wherein said first and second pinion gears, said drive gear and said tension gears have helical teeth.

9. An ink-jet printer having backlash control of a medium advancement system, comprising:

a printhead for ejecting ink droplets onto a print medium in a controlled fashion at a print area;

first media drive means for advancing said print medium through a media path during print operations to position said medium in relation to said printhead, said first drive means comprising a first drive roller means mounted on a first drive shaft to engage a surface of said medium and drive said medium to said print area, said first roller positioned adjacent an input side of a print area, a motor having a motor shaft, a first gear mounted for rotation on said motor shaft, a drive gear mounted on said first drive shaft, said first gear and said drive gear comprising a gear train, wherein teeth of said first gear and said drive gear are in meshing relationship as said motor drives said first gear so as to drive said first roller; and means for controlling gear backlash, comprising means for applying a pinch force to opposed surfaces of said drive gear at a pinched area spaced from a center axis of said drive gear, said pinch force applying means cantilevered at an end of an elongated spring beam, wherein as said first gear rotates in a first direction, said drive gear rotates in a second direction, and friction between said pinch force applying means and said opposed gear surfaces results in a reaction force applied at said end of said spring beam which deflects said beam from a nominal alignment, said deflected beam applying a restoring force on said drive gear tending to rotate said gear in said first direction and keep said teeth of said first and drive gears in mesh as said first gear stops and reverses direction of rotation from said first to said second direction.

10. The printer of claim 9 wherein said pinch force applying means comprises a pair of tensioned grip fingers biased to a pinch point at tips thereof, and wherein said fingers are disposed to contact said opposed surfaces of said drive gear.

11. The system of claim 10 wherein said pinch force applying means comprises a U-shaped member defining said grip fingers.

12. The system of claim 11 wherein said U-shaped member defines a spring element biased to provide said pinch force.

13. The system of claim 9 wherein said spring beam comprises a thin metal beam element.

14. The system of claim 9 wherein said means for controlling gear backlash further includes means for applying a thrust load against said drive gear.

15. The system of claim 9 wherein said pinch force applying means comprises a pair of tensioned grip fingers disposed to contact said opposed surfaces of said drive gear, and wherein a first one of said grip fingers is biased toward an unsprung pinch point, and wherein said means for applying a thrust load comprises said first grip finger, said grip finger being bent away from said unsprung pinch point by contact with one of said gear surfaces, and thereby applying said thrust load against said one surface.

16. The drive system of claim 9 wherein said first and drive gears have helical teeth.

17. A motor drive system having backlash control, comprising:

an electric motor having a motor shaft;

a pinion gear mounted on said shaft;

a drive gear arranged in a gear train with said pinion gear wherein teeth of said pinion gear engage in meshing relationship with teeth of said drive gear as said pinion gear is rotated by operation of said motor; and means for controlling gear backlash, comprising means for applying a pinch force to opposed surfaces of said drive gear at a pinched area spaced from a center axis of said drive gear, said pinch force applying means cantilevered at an end of an elongated spring beam, said beam having a beam section which is secured relative to said gears, wherein as said pinion gear rotates in a first direction, said drive gear rotates in a second direction, and friction between said pinch force applying means and said opposed gear surfaces results in a reaction force applied at said end of said spring beam which deflects said beam from a nominal alignment, said deflected beam applying a restoring force on said drive gear tending to rotate said gear in said first direction and keep said teeth of said first and second gears in mesh as said pinion gear stops and reverses direction of rotation from said first to said second direction.

18. The system of claim 17 wherein said pinch force applying means comprises a pair of tensioned grip fingers biased to a pinch point at tips thereof, and wherein said fingers are disposed to contact said opposed surfaces of said drive gear.

19. The system of claim 18 wherein said pinch force applying means comprises a U-shaped member defining said grip fingers.

20. The system of claim 19 wherein said U-shaped member defines a spring element biased to provide said pinch force.

21. The system of claim 17 wherein said spring beam comprises a thin metal beam element.

22. The system of claim 17 wherein said means for controlling gear backlash further includes means for applying a thrust load against said drive gear.

23. The system of claim 17 wherein said pinch force applying means comprises a pair of tensioned grip fingers disposed to contact said opposed surfaces of said drive gear, and wherein a first one of said grip fingers is biased toward an unsprung pinch point, and wherein said means for applying a thrust load comprises said first grip finger, said grip finger being bent away from said unsprung pinch point by contact with one of said gear surfaces, and thereby applying said thrust load against said one surface.

24. The drive system of claim 17 wherein said first and drive gears have helical teeth.

25. A drive system having backlash control, comprising:

first and second gears arranged in a gear train wherein teeth of said first gear engage in meshing relationship with teeth of said second gear as said first gear is rotated;

means for driving said first gear;

controller means for controlling the operation of said drive means to start and stop: and means for controlling gear backlash, comprising means for applying a pinch force to opposed surfaces of said second gear at a pinched area spaced from a center axis of said second gear, said pinch force applying means cantilevered at an end of an elongated spring beam, wherein as said first gear rotates in a first direction, said second gear rotates in a second direction, and friction between said pinch force applying means and said opposed gear surfaces results in a reaction force applied at said end of said spring beam which deflects said beam from a nominal alignment, said deflected beam applying a restoring force on said second gear tending to rotate said gear in said first direction and keep said teeth of said first and second gears in mesh as said first gear stops and reverses direction of rotation from said first to said second direction.

26. The system of claim 25 wherein said pinch force applying means comprises a pair of tensioned grip fingers biased to a pinch point at tips thereof, and wherein said fingers are disposed to contact said opposed surfaces of said second gear.

27. The system of claim 26 wherein said pinch force applying means comprises a U-shaped member defining said grip fingers.

28. The system of claim 27 wherein said U-shaped member defines a spring element biased to provide said pinch force.

29. The system of claim 25 wherein said spring beam comprises a thin metal beam element.

30. The system of claim 25 wherein said means for controlling gear backlash further includes means for applying a thrust load against said second gear.

31. The system of claim 25 wherein said pinch force applying means comprises a pair of tensioned grip fingers, and wherein said fingers are disposed to contact said opposed surfaces of said second gear, and wherein a first one of said grip fingers is biased toward an unsprung pinch point, and wherein said means for applying a thrust load comprises said first grip finger, said grip finger being bent away from said unsprung pinch by contact with one of said gear surfaces, and thereby applying said thrust load against said one surface.

32. The drive system of claim 25 wherein said first gear is a pinion gear.

33. The drive system of claim 32 wherein said means for driving said first gear comprises an electric motor having a motor shaft, and said pinion gear is mounted for rotation on said electric motor.

34. The drive system of claim 25 wherein said first and second gears have helical teeth.

* * * * *